US006461462B1

(12) United States Patent
Judd et al.

(10) Patent No.: US 6,461,462 B1
(45) Date of Patent: Oct. 8, 2002

(54) ADHESIVE BONDING

(75) Inventors: Peter Thomas Judd, Herts; Robert Graffin McCord, Ballymena, both of (GB)

(73) Assignee: William Clark & Sons Limited, Maghera (GB)

( * ) Notice: Subject to any disclaimer, the term of this patent is extended or adjusted under 35 U.S.C. 154(b) by 0 days.

(21) Appl. No.: 09/497,468

(22) Filed: Feb. 3, 2000

Related U.S. Application Data

(63) Continuation-in-part of application No. 09/042,683, filed on Mar. 12, 1998, and a continuation-in-part of application No. PCT/GB98/03694, filed on Dec. 10, 1998, and a continuation-in-part of application No. PCT/GB96/02254, filed on Sep. 12, 1996.

(30) Foreign Application Priority Data

| | | |
|---|---|---|
| Sep. 14, 1995 | (GB) | 9518818 |
| Dec. 10, 1997 | (GB) | 9726083 |
| Jan. 15, 1998 | (GB) | 9800734 |

(51) Int. Cl.[7] ..... C09J 153/00; B32B 31/00

(52) U.S. Cl. ..... 156/155; 156/325; 428/192; 428/193; 428/194; 428/195; 428/196; 428/198

(58) Field of Search ..... 428/192, 193, 428/194, 195, 196, 198, 200; 156/155, 325

(56) References Cited

U.S. PATENT DOCUMENTS

| | | | |
|---|---|---|---|
| 3,961,125 A | 6/1976 | Suminokura et al. | 428/261 |
| 4,333,980 A | 6/1982 | Russell | 428/192 |

FOREIGN PATENT DOCUMENTS

| | | |
|---|---|---|
| EP | 0 525 251 A1 | 2/1993 |
| GB | 1192022 | 5/1967 |
| GB | 1 507 821 | 4/1978 |
| GB | 2188566 | 10/1987 |

OTHER PUBLICATIONS

Patent Abstracts of Japan, Publication No. 06322331, Publication Date Nov. 22, 1994, Application No. 05133025, Application Date May 10, 1993, Sanyo Chem Ind Ltd., Adhesive for Temporal Tacking on Interlining . . .

Patent Abstracts of Japan, vol. 017, No. 567 (C–1120), Oct. 14, 1993, JP 05 163603 A, Jun. 29, 1993.

*Primary Examiner*—Rich Weisberger
(74) *Attorney, Agent, or Firm*—Ratner & Prestia

(57) ABSTRACT

This invention relates to a method of manufacturing multilayer garments with the use of temporary fusible adhesives, wherein the adhesive has a molecular weight of less than 5000.

9 Claims, 2 Drawing Sheets

ADHESIVE BONDING

Figure 1:
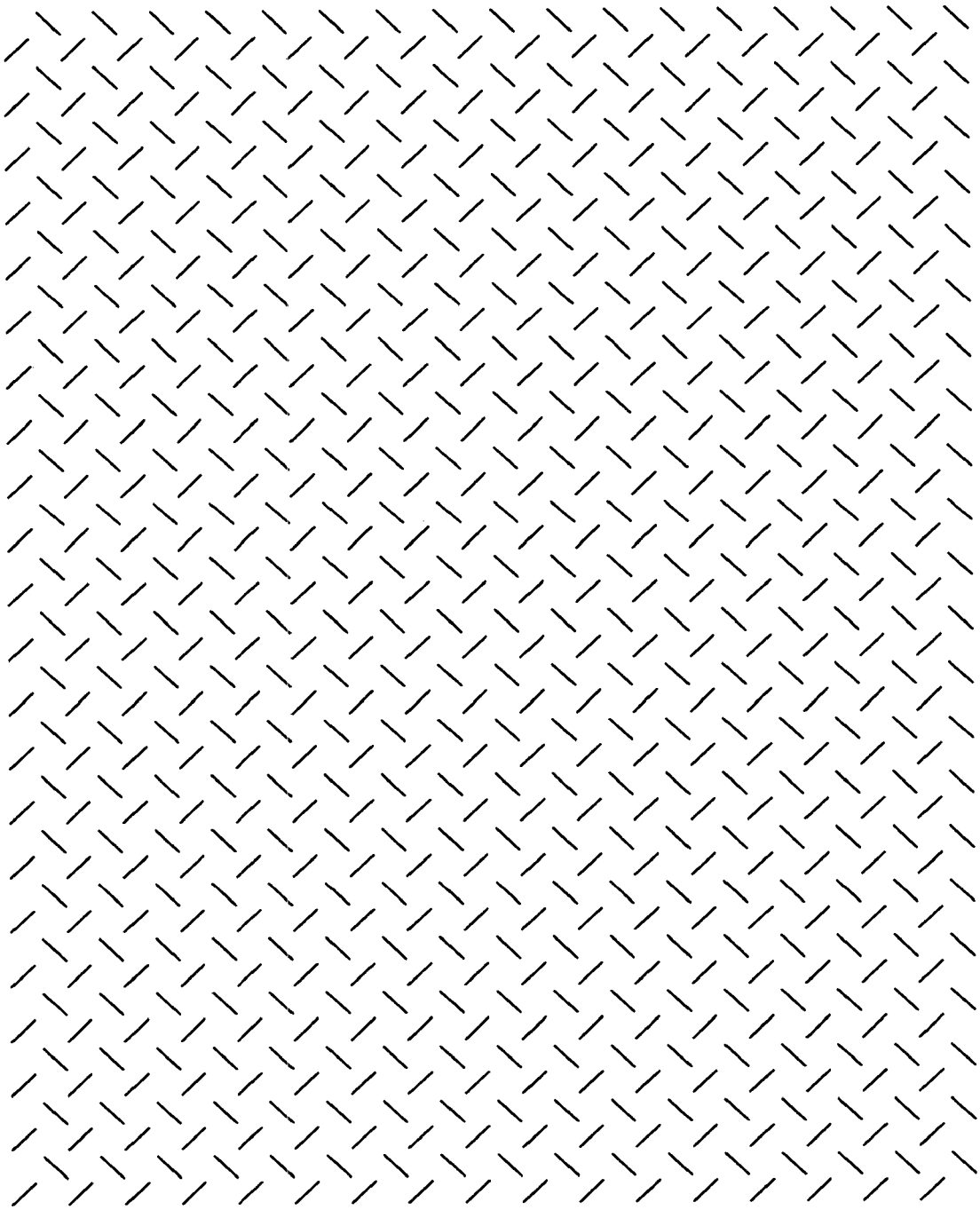

This application is a continuation-in-part of prior application Ser. No. 09/042,683 filed Mar. 12, 1998, and PCT/GB98/03694 and PCT/GB96/02254.

The present invention relates to a method of manufacturing garments and to the use of temporary adhesives in methods of manufacturing garments.

Outerwear garments such as jackets are usually multi-layer garments. For example, a garment can comprise an outer-fabric, interlining, canvas, felt and innerlining.

It is preferable to be able to hold the layers together during manufacture, to allow stitching and then to be able to separate the layers during and/or after manufacture to loosen linings and give the garment a bespoke appearance. Preferably, in a finished garment the outer-fabric should float freely from the interlining to give the same surface effect over the entire garment.

Attempts have been made to temporarily bind the layers of a garment during manufacture. In the past it was necessary to position interlinings against the outer-fabrics by baste stitching them prior to lashing them to various points within the garment.

With advances in adhesive technology attempts have been made to temporarily position interlings by means of an adhesive which is capable of being removed in water washing or drycleaning processes introducing solvents. Use of adhesives in the manufacture of garments has identified problems in that it is difficult to remove adhesive residues from within fine layers. Other problems include uneven delamination and differential shrinkage in solvents.

The present invention aims to provide an improved method for manufacturing a garment using temporary fusible adhesives.

According to the present invention there is provided a method for manufacturing a multi-layered garment comprising the steps of aligning layers where at least one layer is coated with a temporarily fusible adhesive, fusing layers, carrying out at least one conventional manufacturing step, applying heat or a combination of heat and pressure to dissipate adhesive, wherein the adhesive is a low molecular weight adhesive which exhibits a rapid decrease in viscosity upon heating.

Low molecular weight adhesives have molecule weights of less than 5000, more preferably less than 3000, and most preferably less than 1500.

Herein the term multi-layer garment means that there are at least two layers of fabric in one part of a garment when finished.

Preferably the step of applying heat comprises steam pressing the fused fabrics or finished garment.

Preferably at least one layer of the multi-layer garment comprises an interlining base fabric. Suitably the interlining base fabric is chosen from the group comprising a woven canvas, twill, weft insert, condenser fabric or a nonwoven obtainable form textile companies such as William Clark & Sons Ltd.

Preferably the temporary fusible adhesive is coated on the interlining base fabric.

Preferably the fusing step takes place at a temperature of between 40 and 90° C. More preferably the temperature is between 55 and 70° C. Suitably the fusing step can take between 3 and 30 seconds. This time is dependent on the weight of the fabrics and their moisture content, the adhesive and temperature.

Typically, fusing is carried out by hand iron or on an electrically controlled continuous fusing press using line pressures to the compression rollers of between 40 and 80 psi.

The conventional manufacturing steps may include, for example, formation of darts and/or seams to facilitate shaping of the garment.

In a preferred embodiment the adhesive exhibits rapid decreases in viscosity upon heating to temperatures of between 100° C. and 150° C.

The advantage of using a low molecular weight adhesive which exhibits a rapid decrease in viscosity upon heating is that the adhesive will flow away from the glue line, mainly and preferably into the base fabric of the interlining.

Preferably the method comprises the step of applying heat in the presence of a vacuum. This causes the interlining to detach itself from the outer fabric.

The invention also provides the use of a temporary fusible adhesive in garment manufacture when the adhesive is a low molecular weight adhesive which exhibits a rapid decrease in viscosity upon heating.

Preferably the adhesive is applied in a regular coating pattern.

In one embodiment between 0.2 mm to 0.55 mm diameter dots of adhesive are applied in a regular pattern with about 6 to 12 dots per 2.5 cm. Suitably the dots are applied via a screen.

Preferably the diameter of the dots are 0.35 mm and ten dots are applied per 2.5 cm.

In an alternative embodiment the adhesive is applied as 45° slanting slits. Suitably the width of each slit is 0.35 mm and the length of each slit is 3.5 mm. The number of slits per 2.5 cm is 5. The slits may be angled between 0° and 90°. Slit width may be between 0.2 and 0.5 mm and slit length may be between 2 and 5 mm. The slits can alternate in diration.

In yet another embodiment the adhesive is applied in slits which are arranged longitudinally in line with the direction of the run of threads in a fabric.

Suitable resins for use in the method according to the present invention include resin-based adhesives having low molecular weight and a minimum of molecular entanglement.

Such resins include resins made from natural products i.e. rosin derivatives, polymerised rosin, ester gums, terpenes, rosin acids, shellacs. Also, synthetic resins for example ketone and hydrocarbon resins, coumarone inderie and low molecular weight polystyrene resin may be used. Synthetic resin blends such as low molecular ethylene vinyl acetate copolymer and wax blends may also be used.

Preferably the adhesive is applied as an emulsion. Preferably the emulsion comprises resin in water.

Suitably the emulsion can comprise additives chosen from the group comprising viscosity modifiers, plasticisers, optical bleaching agents and humectants.

Preferably the emulsions are print coated through a rotary screen onto base fabrics and dried to form heat sealable resins with melt temperatures between 55–90° C.

Accordingly, the invention provides base fabrics coated with heat sealable resins with melt temperatures between 55–90° C.

Alternatively, the low molecular weighs resins may be applied to interlining base fabrics by printing as a hot melt.

Preferably the application equipment and printing screen are heated to prevent the hot melt from solidifying before it is printed on to the base fabric.

An advantage of this method is that no further heat is required once the dot has been printed onto the base cloth. The main disadvantage is that large volumes of the low melting range resin has to be heated and kept in a molten state and oxidation and degradation can occur.

The invention will now be further demonstrated with reference to the following figures, wherein:

FIG. 1 illustrates a coating pattern comprising 45° C. slanting slits, 0.35 mm wide, 3.5 mm long with 5 slits per 2.5 cm.

Figure 2:
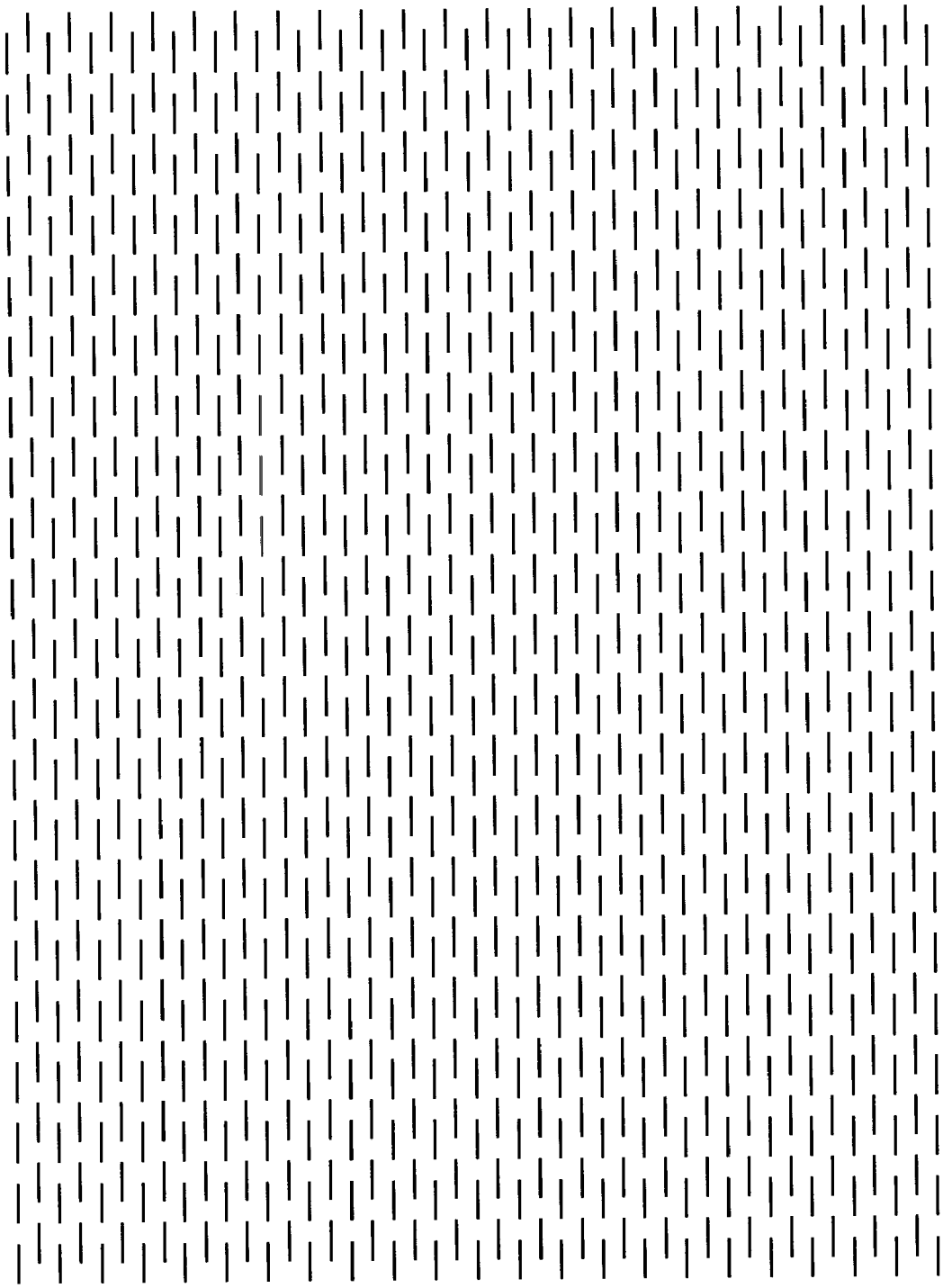

FIG. 2 illustrates a coating pattern comprising vertical slits, 0.35 mm wide, 3.5 mm long with 5 slits per 2.5 cm.

The preferred resin coating medium would be 50% emulsion of an ester gum with a ring and ball softening point of 60° C. before additives are added which is then compounded with the necessary additives to give a clearly printed pattern sitting proudly on the surface of the base fabric having the major part of the printed resin profile available to form an adhesive bond.

A combination of temporary and permanent adhesives may be used in manufacturing a garment.

EXAMPLE 1

Floating Chest Piece

A jacket front may be produced as follows.

The outer fabric is first cut to shape and size. The following parts (trim) are pre-cut to be fused to the front outer fabric of the jacket front.

Trim as follows:

Stay tapes i.e. front edges, shoulders, armholes, pockets, bridle
Lapel piece
Front fusible-temporary bond adhesive applied
Chest felt
Chest canvas (Non-fuse)

Preparation for Fusing

Outer fabric laid flat wrong side up. Firstly the front fusible will be placed onto outer fabric. This will be cut short of the front edge and back from the crease edge of lapel (where the bridle runs as lapel). The remaining staytapes can be placed, that is, front edge, pockets, shoulder and armholes, but not the bridle tape.

The front is now ready to be fused. All the fused parts will be activated by the same given temperature, pressure and time. The key is that both the temporary and permanent fused components are fused under same conditions —at approximately 60° C.

Attaching Floating Chest Piece

The chest felt and chest canvas will be fused together at a separate operation. The chest piece is then laid along the bridle line and the bridle tape is fused holding the chest piece into place. This operation can be done by fusing bridle with hand iron or by passing the complete front through the fusing machine.

EXAMPLE 2

Double Laminate Chest Area

All parts will be cut as method A except for the chest canvas; this will not be needed.

Preparation

All parts will be laid onto the outer fabric as before. But before the fusing operation, the chest felt can be put into place along the bridle line covering the front edge with the bridle tape.

The front can now be fused; it is advised that a higher temperature (approximately 80° C.) be considered so as to accommodate the extra thickness of the chest felt.

EXAMPLE 1 and 2

Make Up

Front darts to be sewn in the outer fabric and pressed open. The chest piece to be sewn to the front canvas along the bridle line.

Sewing Operation

The jacket can now pass through the factory as per normal until ready for final pressing. At this stage it should be given a full dryclean cycle after which it is steam pressed off and finished as normal.

Steam pressing at 110° C. causes temporary adhesive to wick away into the interlining.

EXAMPLE 3

Typically a suitable adhesive formulation comprises an aqueous dispersion of rosin based resins aqueous solution of polymer as a lubricant thickening agents reoderant antifoam.

A suitable dispersion of resins comprises 50% solids and is available as E600 from Permatac TSA.

A suitable lubricant is Mirox OX.

A suitable antifoam is Burst 602.

A suitable reoderant is Tanafresh HFO.

Suitable thickening agents are ALCOPRINT PTK and ALCOPRINT PTU.

The relevant proportions by weights the above ingredients are as follows:

| Resins | Lubricant | Antifoam | Thickener | Reoderant |
|---|---|---|---|---|
| 200 | 40 | 0.8 | 6 | 2 |

A preferred thickness comprises ALOCPRINT PTK and ALCOPRINT PTU, the relative amounts of which are 1:2 respectively.

Suitably the resin and lubricant are mixed, antifoam added and mixed and thickener ALCOPRINT PTK and reoderant added and mixed. The ALCOPRINT PTU is then added slowly to achieve the desired viscosity. The viscosity should read between 15 to 50 on a Brookfield machine. More preferably the viscosity should read between 25 to 40, most preferably between 36 and 40 (i.e. from 17,500 to 20,000 centipoise).

The adhesive would typically be applied to fabric in one of the coating patterns described herein at an amount of between 5 to 20 g/m$^2$. Typically, approximately 10 g/m$^2$ adhesive is applied to interlining and coated interlining is dried at between 50 and 90° C., generally approximately 70° C.

Coated interlining can be fused with fabric at between 40° C. and 90° C. and typically takes 3 to 30 seconds.

The bond strength is typically between 50 and 100 g/25 mm.

What is claimed is:

1. A method for manufacturing multi-layered garments comprising the steps of aligning layers where at least one layer is coated with a temporarily fusible adhesive, fusing layers, carrying out at least one conventional manufacturing step, applying steam or heat or a combination of heat and pressure to dissipate adhesive, wherein the adhesive is an adhesive with a molecular weight of less than 5,000 which exhibits a rapid decrease in viscosity upon heating between the range of 100° C. and 150° C.

2. A method as claimed in claim 1 wherein the step of applying heat comprises steam pressing fused fabrics or finished garments.

3. A method as claimed in claim 1 wherein at least one layer of the multi-layer garment comprises an interlining base fabric, wherein the base fabric is selected from the group comprising canvas, twirl, weft insert, condenser fabric or a non-woven.

4. A method as claimed in claim 3 wherein the temporary fusible adhesive is coated on the interlining base fabric.

5. A method as claimed in claim 1 wherein the fusing step takes place at a temperature of between 40° C. and 90° C.

6. A method as claimed in claim 1 wherein the fusing step takes between 3 and 30 seconds.

7. A method as claimed in claim 1 wherein fusing was carried out by hand iron or an electrically controlled continuous fusing press using line pressures to the compression rollers of between 40 and 80 psi.

8. A method as claimed in claim 1 wherein the adhesive exhibits rapid decreases in viscosity upon heating to temperatures of between 100° C. and 150° C.

9. A method as claimed in claim 1 wherein the step of applying heat occurs in the presence of a vacuum.

* * * * *